US009411290B2

(12) United States Patent
Shinagawa

(10) Patent No.: US 9,411,290 B2
(45) Date of Patent: Aug. 9, 2016

(54) IMAGE FORMING APPARATUS CONFIGURED TO SET AN INITIAL VALUE OF AN AMOUNT OF RECORDING MATERIAL REMAINING IN A CONTAINING UNIT, ASSOCIATED CONTROL METHOD, AND STORAGE MEDIUM

(71) Applicant: CANON KABUSHIKI KAISHA, Tokyo (JP)

(72) Inventor: Kazutaka Shinagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/470,672

(22) Filed: Aug. 27, 2014

(65) Prior Publication Data

US 2015/0063833 A1 Mar. 5, 2015

(30) Foreign Application Priority Data

Aug. 30, 2013 (JP) ..... 2013-179997

(51) Int. Cl.
*G03G 15/00* (2006.01)
*G03G 15/08* (2006.01)

(52) U.S. Cl.
CPC ..... *G03G 15/556* (2013.01); *G03G 15/0863* (2013.01)

(58) Field of Classification Search
CPC ... G03G 15/55; G03G 15/553; G03G 15/556; G03G 15/0863; G03G 2215/0695; G03G 2215/0697; G03G 21/1878; G03G 21/1882; G03G 21/1885; G03G 21/1889; G03G 21/1892; G03G 21/1896
See application file for complete search history.

(56) References Cited

U.S. PATENT DOCUMENTS

| | | | | |
|---|---|---|---|---|
| 6,587,649 | B1 * | 7/2003 | Yamamoto et al. | 399/27 |
| 6,591,070 | B1 * | 7/2003 | Shoji et al. | 399/27 |
| 2004/0070642 | A1 * | 4/2004 | Murakami et al. | 347/19 |
| 2005/0163514 | A1 * | 7/2005 | Hwang | 399/8 |
| 2010/0172659 | A1 * | 7/2010 | Jeon | G03G 15/553 399/12 |
| 2010/0232816 | A1 * | 9/2010 | Tan et al. | 399/27 |

FOREIGN PATENT DOCUMENTS

JP 2006-343621 A 12/2006

* cited by examiner

*Primary Examiner* — Clayton E Laballe
*Assistant Examiner* — Trevor J Bervik
(74) *Attorney, Agent, or Firm* — Canon USA Inc. IP Division

(57) ABSTRACT

When a toner cartridge is mounted to an image forming apparatus, if the toner cartridge is new, the image forming apparatus sets a value calculated from cartridge capacity as an initial value of a toner remaining amount. If, when the toner cartridge is mounted to the image forming apparatus, the toner cartridge is not new, the image forming apparatus sets a value calculated from a page count number as the initial value of the toner remaining amount. Furthermore, when the toner cartridge is mounted to the image forming apparatus, the image forming apparatus acquires a sensor value, and if the acquired sensor value is an indefinite value, the image forming apparatus determines an alternative value according to sensor ability as the initial value of the toner remaining amount.

18 Claims, 8 Drawing Sheets

IMAGE FORMING APPARATUS CONFIGURED TO SET AN INITIAL VALUE OF AN AMOUNT OF RECORDING MATERIAL REMAINING IN A CONTAINING UNIT, ASSOCIATED CONTROL METHOD, AND STORAGE MEDIUM

BACKGROUND

1. Field

Aspects of the present invention generally relate to an image forming apparatus, a control method, and a storage medium.

2. Description of the Related Art

Image forming apparatuses form an image on a sheet using a recording material such as toner. In general, the recording material is contained in a containing unit such as a cartridge. Some image forming apparatuses detect the amount of recording material remaining in the containing unit, and display a value acquired by the detection on a display unit such as a user interface (UI).

Conventionally, a sensor has been provided, and a value detected by the sensor has been directly displayed as the amount of remaining recording material. In many cases, there has been adopted a sensor capable of demonstrating high detection accuracy only when the remaining amount is smaller than a certain level, in view of factors such as cost. In such cases, the sensor discretely detects, for example, 100%, 20%, and 0% as the amount of remaining recording material. Accordingly, the display unit also discretely displays, for example, 100%, 20%, and 0% as the amount of remaining recording material.

In contrast, Japanese Patent Application Laid-Open No. 2006-343621 discusses a technique for displaying on a display unit the amount of remaining recording material in continuous percentages while adopting a sensor that discretely detects a remaining amount. For example, when image formation is performed, a predicted value of a toner remaining amount is calculated based on a dot count value of raster data. The calculated predicted value is then displayed as a current value of the toner remaining amount. When a sensor value of the toner remaining amount is acquired from the sensor, the current value is updated with the acquired sensor value.

When a toner cartridge is replaced, it is necessary to initialize the current value of the toner remaining amount. Therefore, a toner remaining amount value stored in a memory tag of the toner cartridge is adopted as an initial value of the toner remaining amount.

However, when the toner remaining amount value is not stored in the memory tag of the toner cartridge, the current value of the toner remaining amount cannot be appropriately initialized. Therefore, the toner remaining amount cannot be appropriately displayed at least until the sensor detects the toner remaining amount.

SUMMARY

Aspects of the present invention are generally directed to an image forming apparatus capable of appropriately initializing a current value of a toner remaining amount even if a toner remaining amount value is not stored in a memory tag of a toner cartridge when the toner cartridge is mounted.

According to an aspect of the present invention, an image forming apparatus performing image formation using a recording material stored in a containing unit includes an acquisition unit configured to acquire information from the containing unit when the containing unit is mounted to the image forming apparatus, the information indicating a number of pages for which image formation is executable using the recording material stored in the containing unit from a state in which the containing unit is new, a calculation unit configured to calculate, based on the information, an amount of the recording material remaining in the containing unit if a new containing unit is mounted to the image forming apparatus, and a setting unit configured to set a value representing the amount calculated by the calculation unit as an initial value of an amount of the recording material remaining in the containing unit.

Further features of the present disclosure will become apparent from the following description of exemplary embodiments with reference to the attached drawings.

DESCRIPTION OF THE EMBODIMENTS

Figure 1:
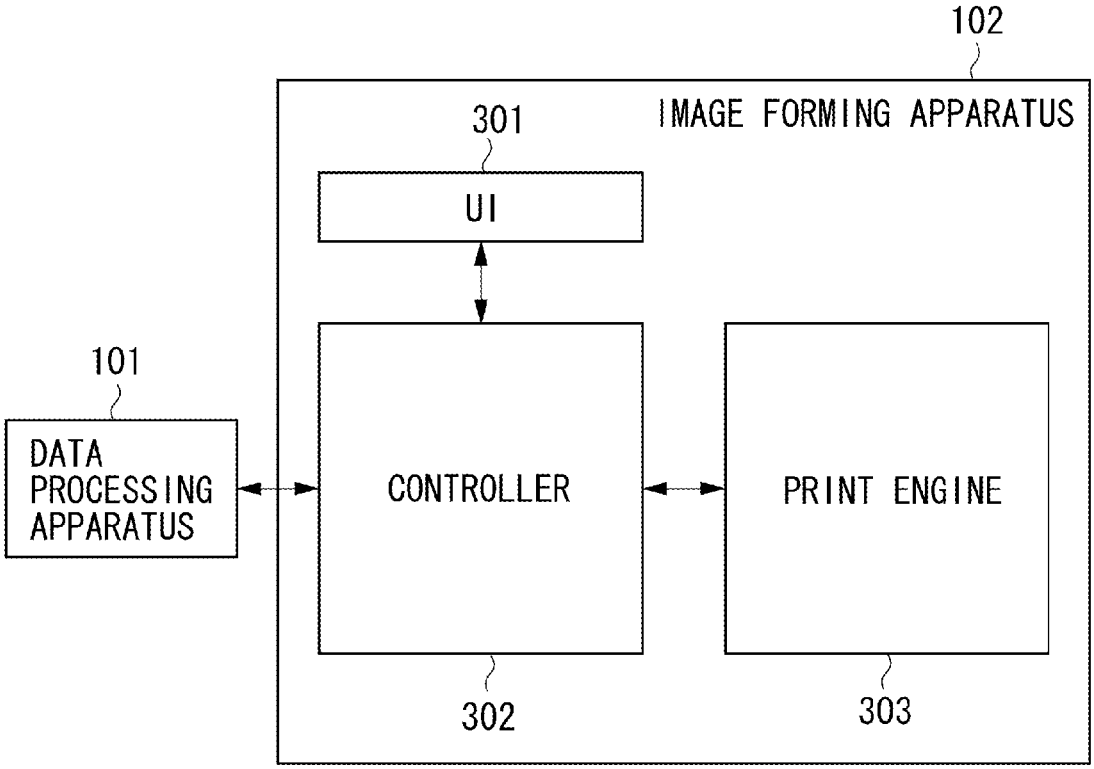
FIG. 1 is a block diagram illustrating a configuration of an image forming apparatus.

FIG. 1 is a block diagram illustrating a configuration of an image forming apparatus according to a first exemplary embodiment.

A data processing apparatus 101 (e.g., a personal computer (PC)) generates image data, and transmits the generated image data to an image forming apparatus 102.

The image forming apparatus 102 (e.g., a laser beam printer) receives the image data from the data processing apparatus 101, and forms an image on a sheet based on the received image data. The image forming apparatus 102 may be a multi-function peripheral having functions such as a scanner function and a fax function.

A UI 301 has a display unit displaying various types of information to a user, and an operation unit accepting various operations from the user. On the display unit, a current value of a toner remaining amount, which will be described below, is displayed. The current value of the toner remaining amount may be transmitted to an external apparatus such as the data processing apparatus 101 via an external interface (I/F), and displayed on a display unit of the external apparatus.

A controller 302 generates bitmap data based on page-description language (PDL) data, and transmits the generated bitmap data to a print engine 303. The controller 302 will be described in detail below with reference to FIG. 2.

Based on the bitmap data received from the controller 302, the print engine 303 performs image formation on a sheet by using toner in an electrophotographic method. The method of the image formation may be methods other than the electrophotographic method, for example, an inkjet method. In such a case, a recording material in the inkjet method is ink whereas a recording material in the electrophotographic method is toner.

The controller 302 and the print engine 303 are provided as separate components, but may be combined into one unit.

Figure 2:
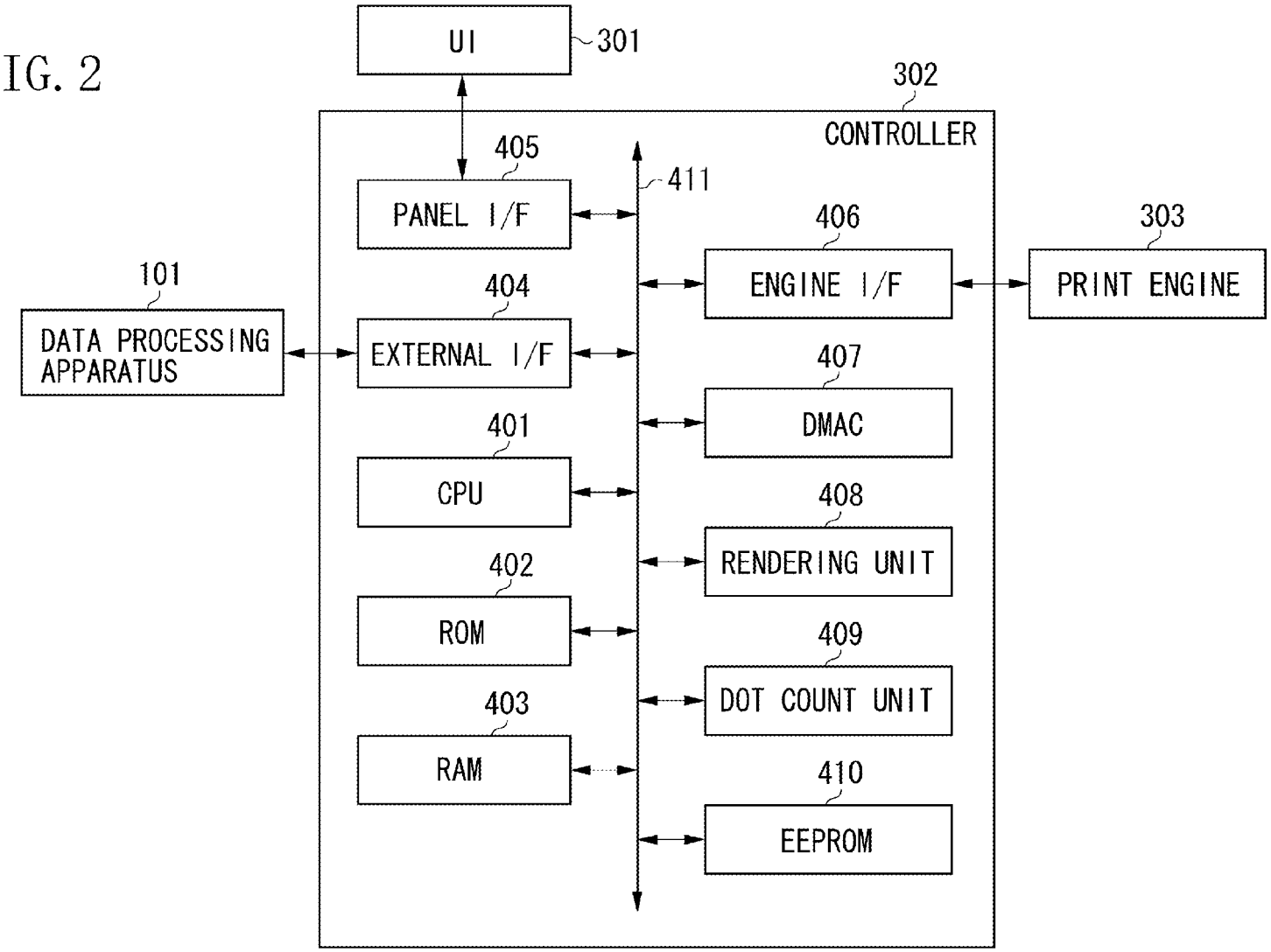
FIG. 2 is a block diagram illustrating a configuration of a controller.

FIG. 2 is a block diagram illustrating a configuration of the controller 302.

A central processing unit (CPU) 401 controls the image forming apparatus 102 by loading, into a random-access memory (RAM) 403, a program stored in a read-only memory (ROM) 402, and executing the program. Further, as described below, the CPU 401 calculates a toner remaining amount, based on a predicted value of a toner consumption amount and a sensor value of a toner remaining amount. The predicted value of the toner consumption amount is converted from a dot count value acquired by a dot count unit 409. The CPU 401 is notified by the print engine 303 of the sensor value of the toner remaining amount. The CPU 401 then causes the UI 301 to display the calculated toner remaining amount via a panel I/F 405, or notifies the data processing apparatus 101 of the calculated toner remaining amount via an external I/F 404.

The ROM 402 stores information such as the program to be executed by the CPU 401.

The RAM 403 stores information such as the program loaded from the ROM 402. The RAM 403 also stores PDL data, intermediate data generated by interpreting the PDL data, bitmap data generated by rendering the intermediate data, and temporary statuses of various types of processing and log information that are necessary for other processing.

The external I/F 404 interconnects the data processing apparatus 101 and the controller 302, and relays data communication, i.e., transmission and reception of data, performed therebetween.

The panel I/F 405 interconnects the UI 301 and the controller 302, and relays data communication, i.e., transmission and reception of data, performed therebetween.

An engine I/F 406 interconnects the print engine 303 and the controller 302, and relays data communication, i.e., transmission and reception of data, performed therebetween.

A direct memory access controller (DMAC) 407 performs data access to the RAM 403, i.e., writing and reading of data into and from the RAM 403, upon receipt of a command from the CPU 401.

A rendering unit 408 rasterizes the intermediate data into the bitmap data.

The dot count unit 409 counts the number of dots consuming the toner in image formation, among dots included in the rasterized bitmap data. Specifically, the dot count unit 409 counts the number of dots corresponding to colors other than white. For example, in a case of monochrome printing, the dot count unit 409 counts the number of dots corresponding to K (black). In a case of color printing, the dot count unit 409 counts the number of dots corresponding to any of Y (yellow), M (magenta), C (cyan), and K (black). The CPU 401 or the rendering unit 408 may count the number of dots.

An electrically erasable programmable ROM (EEPROM) 410 stores information such as setting information of the image forming apparatus 102.

A bus 411 interconnects components in the controller 302.

Figure 3:
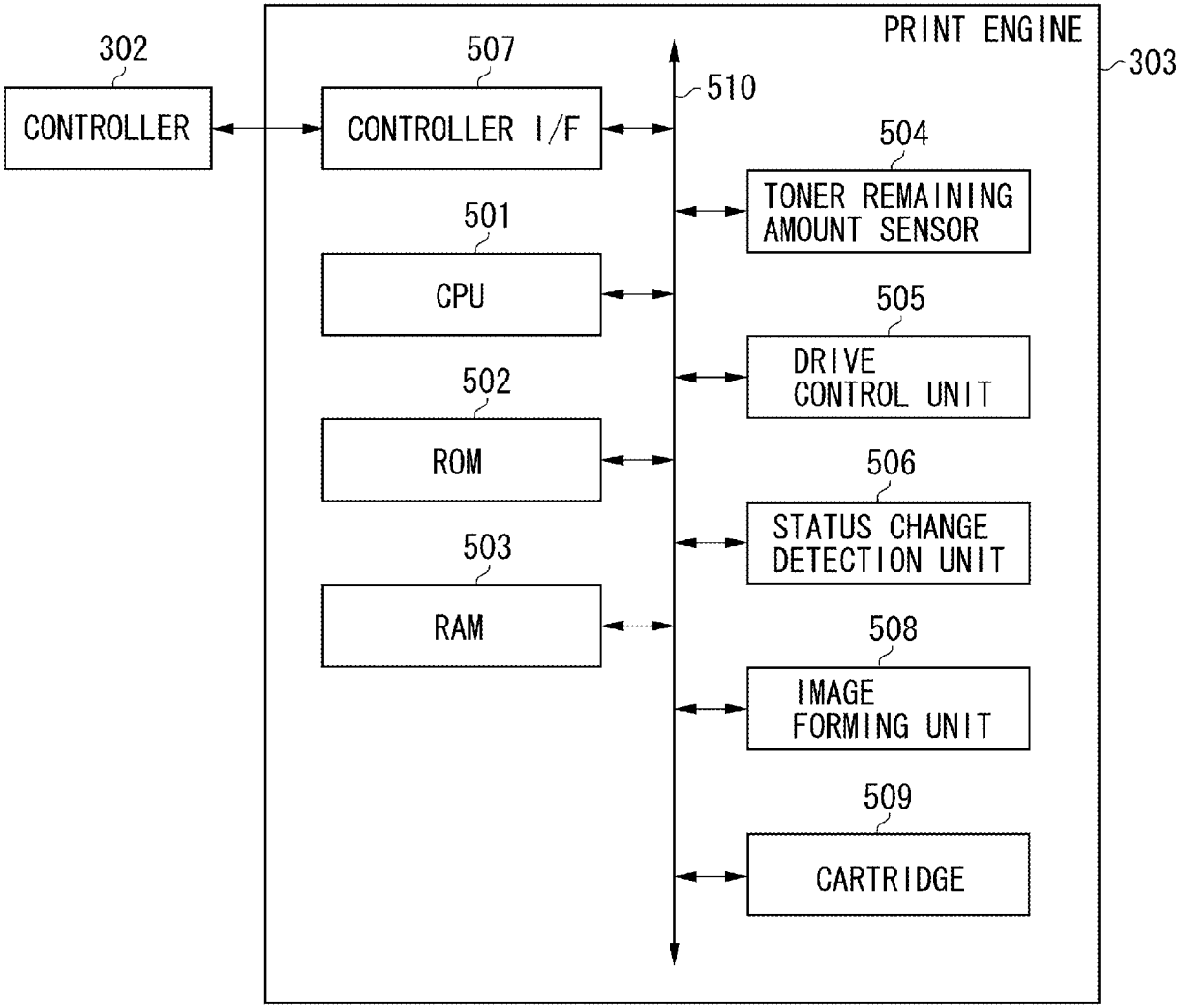
FIG. 3 is a block diagram illustrating a configuration of a print engine.

FIG. 3 is a block diagram illustrating a configuration of the print engine 303.

A CPU 501 controls the print engine 303 by loading into a RAM 503 a program stored in a ROM 502, and executing the program.

The ROM 502 stores information such as the program to be executed by the CPU 501.

The RAM 503 stores information such as the program loaded from the ROM 502.

A toner remaining amount sensor 504 measures the amount of toner remaining in a cartridge 509. Examples of a method for detecting the toner remaining amount employed in the toner remaining amount sensor 504 include a permeability detecting method, a magnetic method, a piezoelectric vibration method, and a transmitted light method. When the toner remaining amount reaches a predetermined value such as 20% and 0%, the toner remaining amount sensor 504 detects the value as the sensor value. More specifically, as the sensor value, the toner remaining amount sensor 504 detects "100%" when the toner remaining amount is in a range of 100% to 21%, "20%" when the toner remaining amount is in a range of 20% to 1%, and "0%" when the toner remaining amount is 0%. The toner remaining amount sensor 504 may be provided inside the cartridge 509.

A drive control unit 505 drives various motors that are necessary for an image forming unit 508 to perform image formation.

A status change detection unit 506 detects a status change such as a jam and cover opening in the image forming apparatus 102. The status change detection unit 506 further detects replacement of the cartridge 509. The status change may be detected by the CPU 501.

A controller I/F 507 interconnects the controller 302 and the print engine 303, and relays data communication, i.e., transmission and reception of data, performed therebetween.

The image forming unit 508 performs image formation on a sheet by using the toner in the electrophotographic method, based on the bitmap data received from the controller 302.

The cartridge 509 is a process cartridge mountable to the image forming apparatus 102, as a containing unit containing the toner. The cartridge 509 stores the toner to be used when the image forming unit 508 performs image formation. Further, the cartridge 509 includes a nonvolatile storage medium that stores cartridge information therein. Examples of the cartridge information include information indicating whether the cartridge 509 is new, color information indicating the color of the cartridge 509, and toner remaining amount information indicating the amount of the toner currently remaining in the cartridge 509. Although the cartridge 509 is connected to a bus 510, the cartridge 509 may be connected to the CPU 501 via a dedicated line.

The bus 510 interconnects components in the print engine 303.

Figure 4:
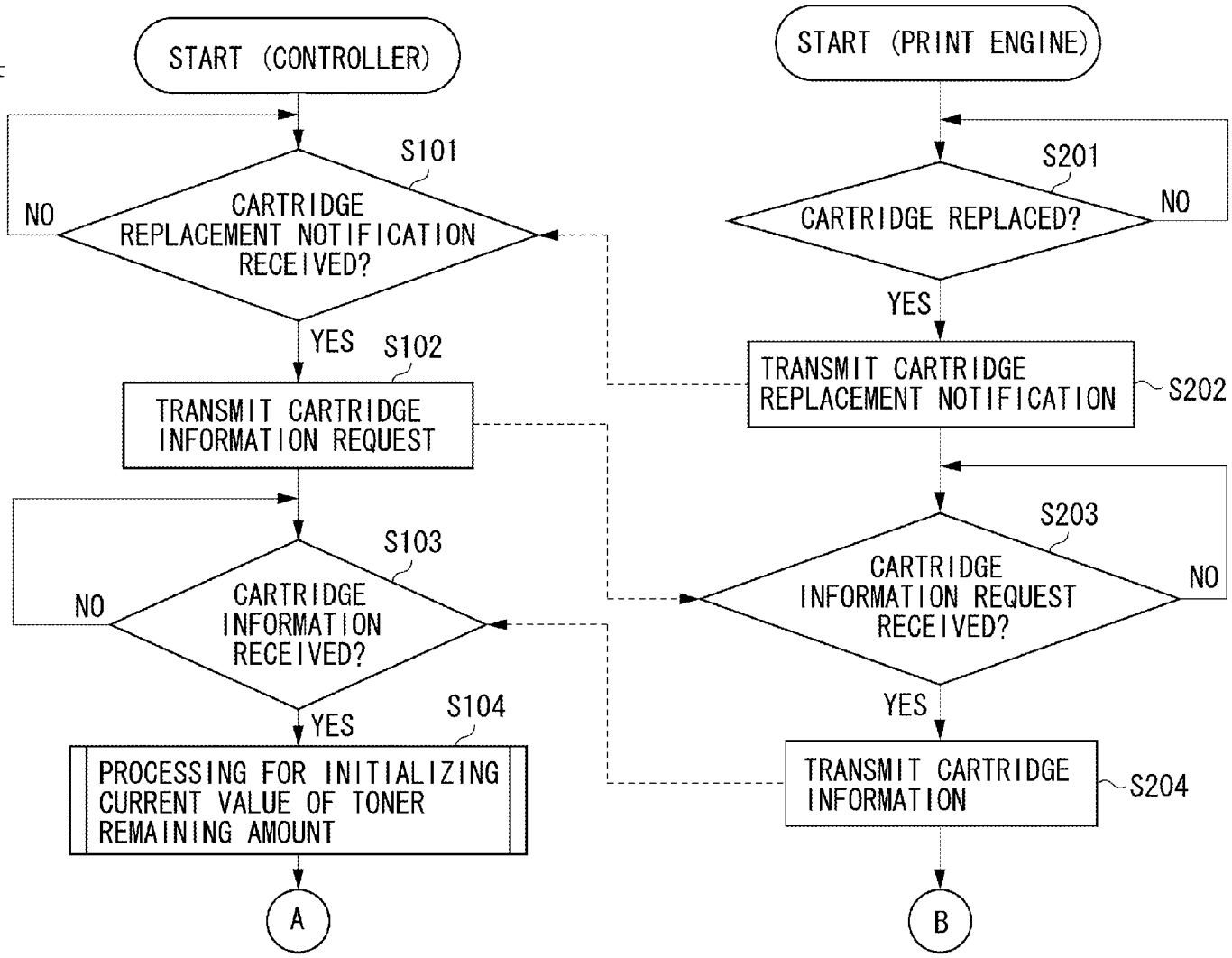
FIG. 4 is a flowchart (a first half) illustrating control for detecting a toner remaining amount.
Figure 5A:
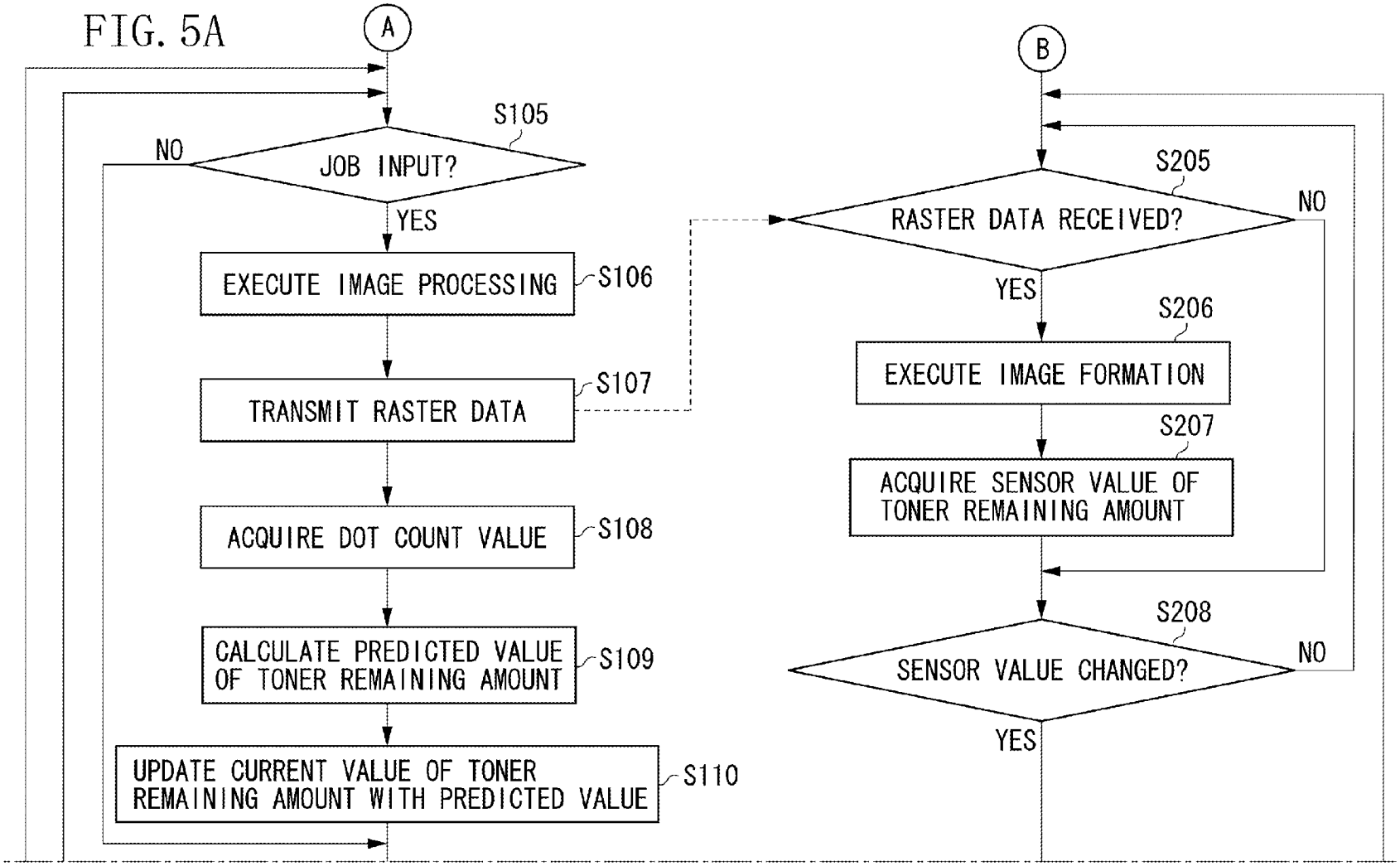
FIGS. 5A and 5B are flowcharts (a second half) illustrating the control for detecting the toner remaining amount.
Figure 5B:
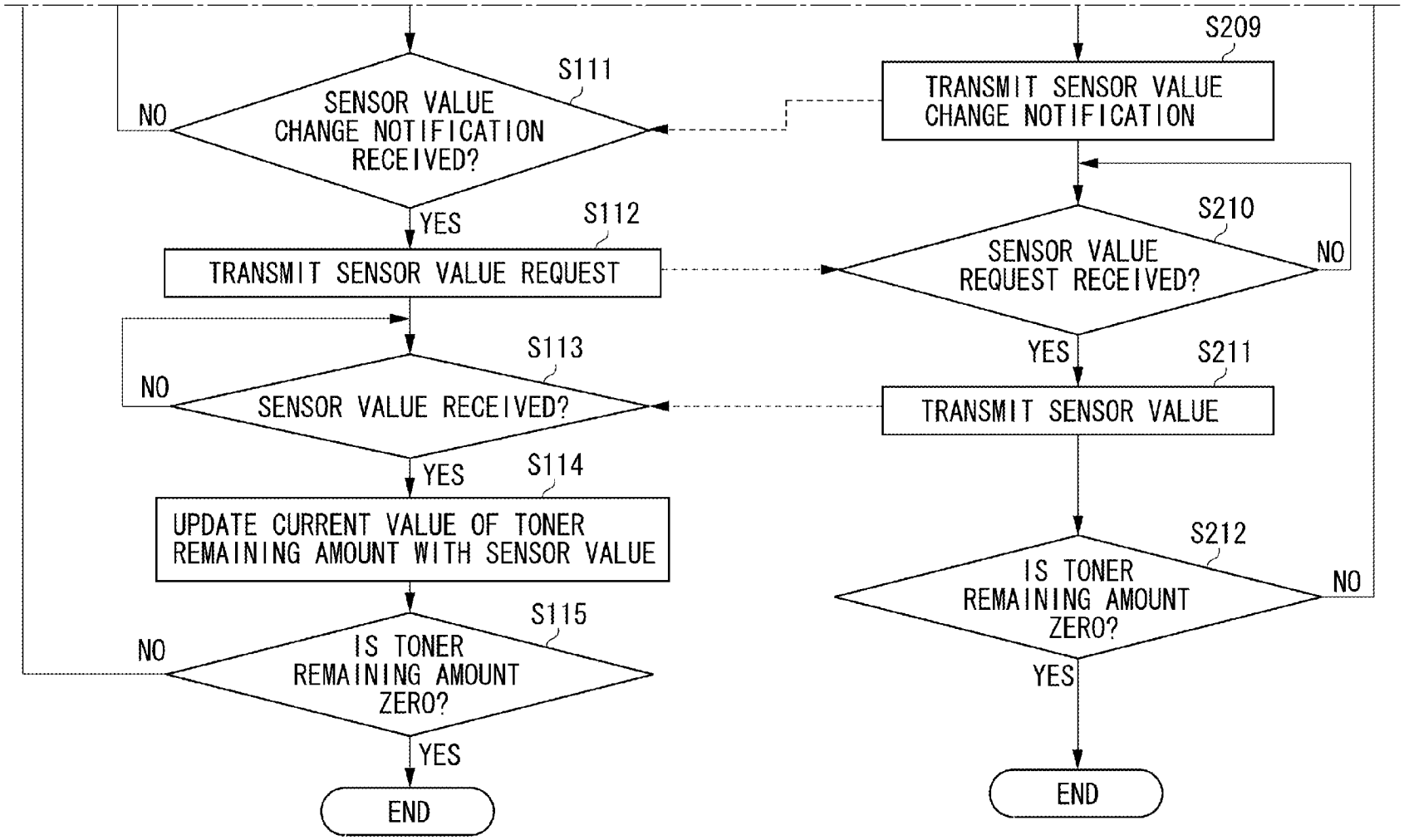

FIGS. 4, 5A, and 5B illustrate flowcharts indicating control for detecting the toner remaining amount.

In each of FIGS. 4, 5A, and 5B, the flowchart on the left indicates the control performed by the CPU 401 in the controller 302. This control is implemented when the CPU 401 loads a control program stored in the ROM 402 into the RAM 403 to execute the control program. On the other hand, the flowchart on the right indicates the control performed by the CPU 501 in the print engine 303. This control is implemented when the CPU 501 loads a control program stored in the ROM 502 into the RAM 503 to execute the control program.

First, in step S201, the CPU 501 determines whether the cartridge 509 has been replaced. This determination is made by detecting that the cartridge 509 has been newly mounted to the image forming apparatus 102. The mounted cartridge 509 is recognized when the status change detection unit 506 detects that the cartridge 509 has been mounted and notifies the CPU 501 of the detection. The mounted cartridge 509 may be detected by detecting opening/closing of a cover provided for replacing the cartridge 509. Alternatively, the mounted cartridge 509 may be detected via a button or a switch whose ON/OFF state changes in hardware in response to a component being mounted or removed. When the CPU 501 determines that the cartridge 509 has been replaced (YES in step S201), the CPU 501 proceeds to step S202. When the CPU 501 determines that the cartridge 509 has not been replaced (NO in step S201), the CPU 501 stays on standby.

Then, in step S202, the CPU 501 transmits a cartridge replacement notification indicating that the cartridge 509 has been replaced to the controller 302 via the controller I/F 507.

Next, in step S101, the CPU 401 determines whether the cartridge replacement notification has been received from the print engine 303 via the engine I/F 406. When the CPU 401 determines that the cartridge replacement notification has been received (YES in step S101), the CPU 401 proceeds to step S102. When the CPU 401 determines that the cartridge replacement notification has not been received (NO in step S101), the CPU 401 stays on standby.

Then, in step S102, the CPU 401 transmits a cartridge information request for requesting cartridge information of the cartridge 509 to the print engine 303 via the engine I/F 406.

Next, in step S203, the CPU 501 determines whether the cartridge information request has been received from the controller 302 via the controller I/F 507. When the CPU 501 determines that the cartridge information request has been received (YES in step S203), the CPU 501 proceeds to step S204. When the CPU 501 determines that the cartridge information request has not been received (NO in step S203), the CPU 501 stays on standby.

Then, in step S204, the CPU 501 transmits the cartridge information of the cartridge 509, to the controller 302 via the controller I/F 507.

Next, in step S103, the CPU 401 determines whether the cartridge information has been received from the print engine 303 via the engine I/F 406. When the CPU 401 determines that the cartridge information has been received (YES in step S103), the CPU 401 proceeds to step S104. When the CPU 401 determines that the cartridge information has not been received (NO in step S103), the CPU 401 stays on standby.

Then, in step S104, the CPU 401 initializes the current value of the toner remaining amount based on the cartridge information. Here, the current value of the toner remaining amount is a value recognized by the controller 302 as the toner remaining amount of the cartridge 509, and displayed to a user via the UI 301. The current value of the toner remaining amount is held in a memory such as the RAM 403. This step S104 will be described in detail below with reference to FIG. 7.

Then, in step S105, the CPU 401 determines whether a job demanding execution of image formation has been input from the data processing apparatus 101 via the external I/F 404. Here, examples of the job include a PDL print job, a copy job, and a FAX reception print job. When the CPU 401 determines that the job has been input (YES in step S105), the CPU 401 proceeds to step S106. When the CPU 401 determines that the job has not been input (NO in step S105), the CPU 401 proceeds to step S111.

Next, in step S106, the CPU 401 executes image processing necessary for the image formation based on the job. Here, the image processing includes processing for generating raster data by controlling the rendering unit 408 to rasterize print data.

Then, in step S107, the CPU 401 transmits the raster data generated through the image processing to the print engine 303 via the engine I/F 406.

Next, in step S108, the CPU 401 acquires from the dot count unit 409 a dot count value measured at the time of the generation of the raster data. The dot count value may be acquired page by page, or may be acquired job by job.

Then, in step S109, the CPU 401 calculates the predicted value of the toner remaining amount, based on the dot count value acquired in step S108. Specifically, at first, the CPU 401 performs the following calculation: (the dot count value [dot] in print execution of this job or page)×(a toner consumption amount per dot [g/dot])=(a toner consumption amount [g] due to this job execution). Here, the toner consumption amount per dot may be stored beforehand in the ROM 402, or may be included in the cartridge information received in step S103. Next, the CPU 401 performs the following calculation: (the current toner remaining amount [g])−(the toner consumption amount [g] due to the execution of this job)=(a new toner remaining amount [g]). Next, the CPU 401 performs the following calculation: (the new toner remaining amount [g])/(a toner remaining amount [g] in a state in which a cartridge is unused)=(a predicted value [%] of the new toner remaining amount). Here, the toner remaining amount in the state in which the cartridge is unused may be stored beforehand in the ROM 402, or may be included in the cartridge information received in step S103.

Next, in step S110, the CPU 401 updates the current value of the toner remaining amount with the predicted value calculated in step S109.

Meanwhile, in step S205, the CPU 501 determines whether the raster data has been received from the controller 302 via the controller I/F 507. When the CPU 501 determines that the raster data has been received (YES in step S205), the CPU 501 proceeds to step S206. When the CPU 501 determines that the raster data has not been received (NO in step S205), the CPU 501 proceeds to step S208.

Then, in step S206, the CPU 501 controls the image forming unit 508 to perform the image formation based on the raster data.

Next, in step S207, the CPU 501 acquires the sensor value of the toner remaining amount from the toner remaining amount sensor 504. The sensor value may be acquired upon completion of the image formation per page, or upon completion of the image formation per job. Alternatively, the sensor value may be acquired each time a predetermined time elapses.

Then, in step S208, the CPU 501 determines whether there is any change between the sensor value acquired this time and a previously acquired sensor value. When the CPU 501 determines that the sensor value has changed (YES in step S208), the CPU 501 proceeds to step S209. When the CPU 501 determines that the sensor value has not changed (NO in step S208), the CPU 501 returns to step S205.

Next, in step S209, the CPU 501 transmits a sensor value change notification indicating that the sensor value has changed, to the controller 302 via the controller I/F 507.

Next, in step S111, the CPU 401 determines whether the sensor value change notification has been received from the print engine 303 via the engine I/F 406. When the CPU 401 determines that the sensor value change notification has been received (YES in step S111), the CPU 401 proceeds to step S112. When the CPU 401 determines that the sensor value change notification has not been received (NO in step S111), the CPU 401 returns to step S105.

Then, in step S112, the CPU 401 transmits a sensor value request for requesting the sensor value to the print engine 303 via the engine I/F 406.

Next, in step S210, the CPU 501 determines whether the sensor value request has been received from the controller 302 via the controller I/F 507. When the CPU 501 determines that the sensor value request has been received (YES in step S210), the CPU 501 proceeds to step S211. When the CPU 501 determines that the sensor value request has not been received (NO in step S210), the CPU 501 stays on standby.

Then, in step S211, the CPU 501 transmits the sensor value to the controller 302 via the controller I/F 507.

Next, in step S113, the CPU 401 determines whether the sensor value has been received from the print engine 303 via the engine I/F 406. When the CPU 401 determines that the sensor value has been received (YES in step S113), the CPU 401 proceeds to step S114. When the CPU 401 determines that the sensor value has not been received (NO in step S113), the CPU 401 stays on standby.

Then, in step S114, the CPU 401 updates the current value of the toner remaining amount with the sensor value received in step S113.

Next, in step S115, the CPU 401 determines whether the toner remaining amount is zero, with reference to the current value of the toner remaining amount. When the CPU 401 determines that the toner remaining amount is zero (YES in step S115), the CPU 401 completes the processing. When the CPU 401 determines that the toner remaining amount is not zero (NO in step S115), the CPU 401 returns to step S105.

Meanwhile, in step S212, the CPU 501 determines whether the toner remaining amount is zero, with reference to the sensor value of the toner remaining amount. When the CPU 501 determines that the toner remaining amount is zero (YES in step S212), the CPU 501 completes the processing. When the CPU 501 determines that the toner remaining amount is not zero (NO in step S212), the CPU 501 returns to step S205.

Figure 6:
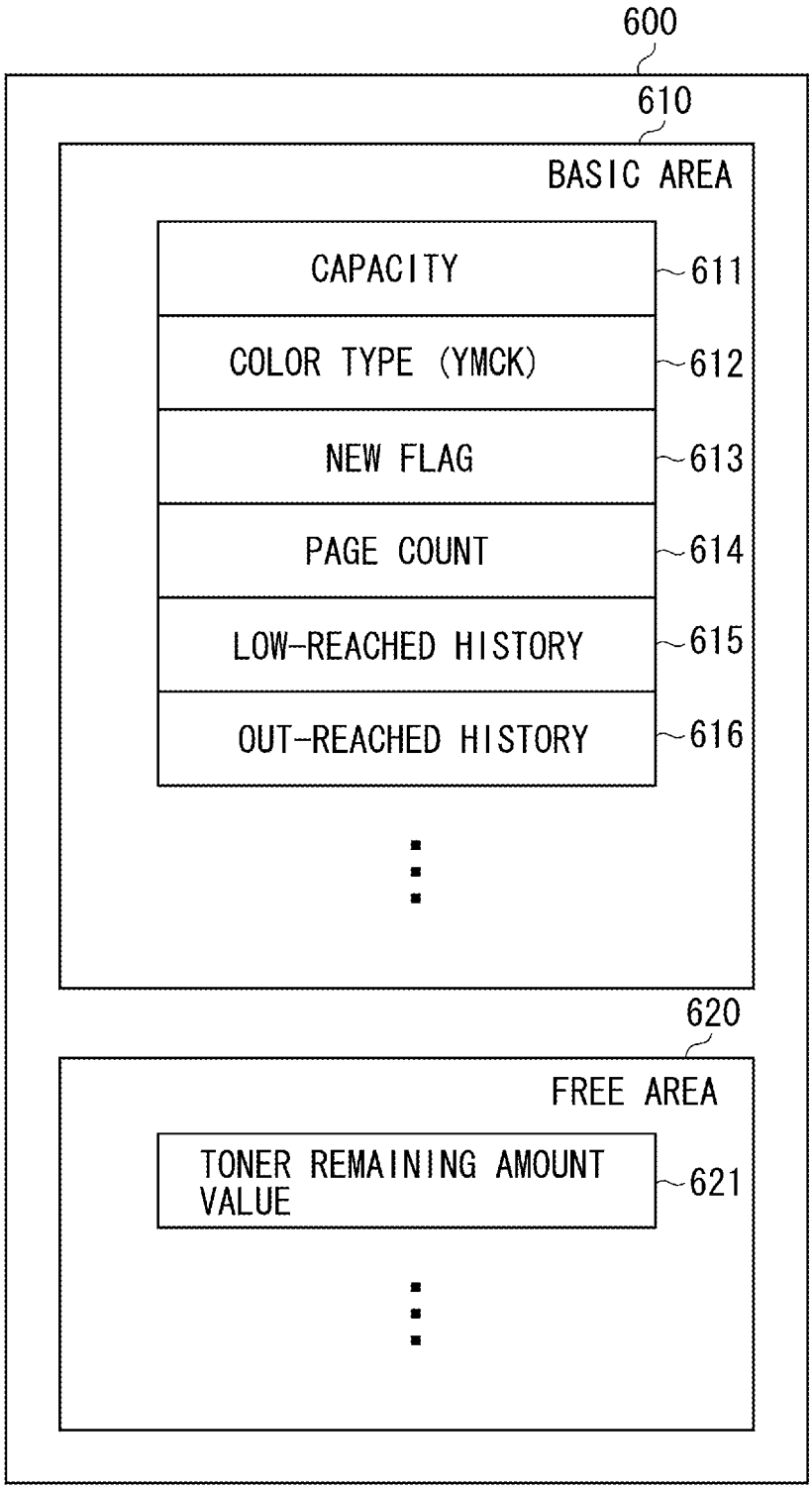
FIG. 6 is a diagram illustrating a data configuration of a memory tag.

FIG. 6 is a diagram illustrating a data configuration of a memory tag. The memory tag is the nonvolatile storage medium included in the cartridge 509.

An entire data area 600 includes a basic area 610 and a free area 620.

The basic area 610 includes a capacity 611, a color type (YMCK) 612, a new flag 613, a page count 614, a Low-reached history 615, and an Out-reached history 616. These will be referred to as "cartridge information".

The capacity 611 indicates a toner amount that can be stored in the cartridge 509 (i.e., the toner remaining amount when the cartridge 509 is new and full). Specifically, the capacity 611 indicates the number of pages for which image formation is executable from a state in which the cartridge 509 is new.

The color type (YMCK) 612 indicates the color of the toner stored in the cartridge 509.

The new flag 613 indicates whether the cartridge 509 is new.

The page count 614 indicates the number of pages printed using the cartridge 509 (the number of pages for which image formation has been executed).

The Low-reached history 615 indicates whether the toner remaining amount of the cartridge 509 has reached a Low level (20%). The Low level is a value indicating that an amount of recording material remaining is small. This value may be a value other than 20% (e.g., 10% or 15%).

The Out-reached history 616 indicates whether the toner remaining amount of the cartridge 509 has reached an Out level (0%). The Out level is a value indicating that an amount of recording material remaining is zero. This value may be a value other than 0% (e.g., in a range of 1% to 3%).

The free area 620 includes a toner remaining amount value 621. New information can be added or a modification of information can be made to the free area 620 freely, according to a request by the CPU 501.

The toner remaining amount value 621 indicates the toner remaining amount [%] of the cartridge 509. The toner remaining amount may be stored in [g].

Figure 7:
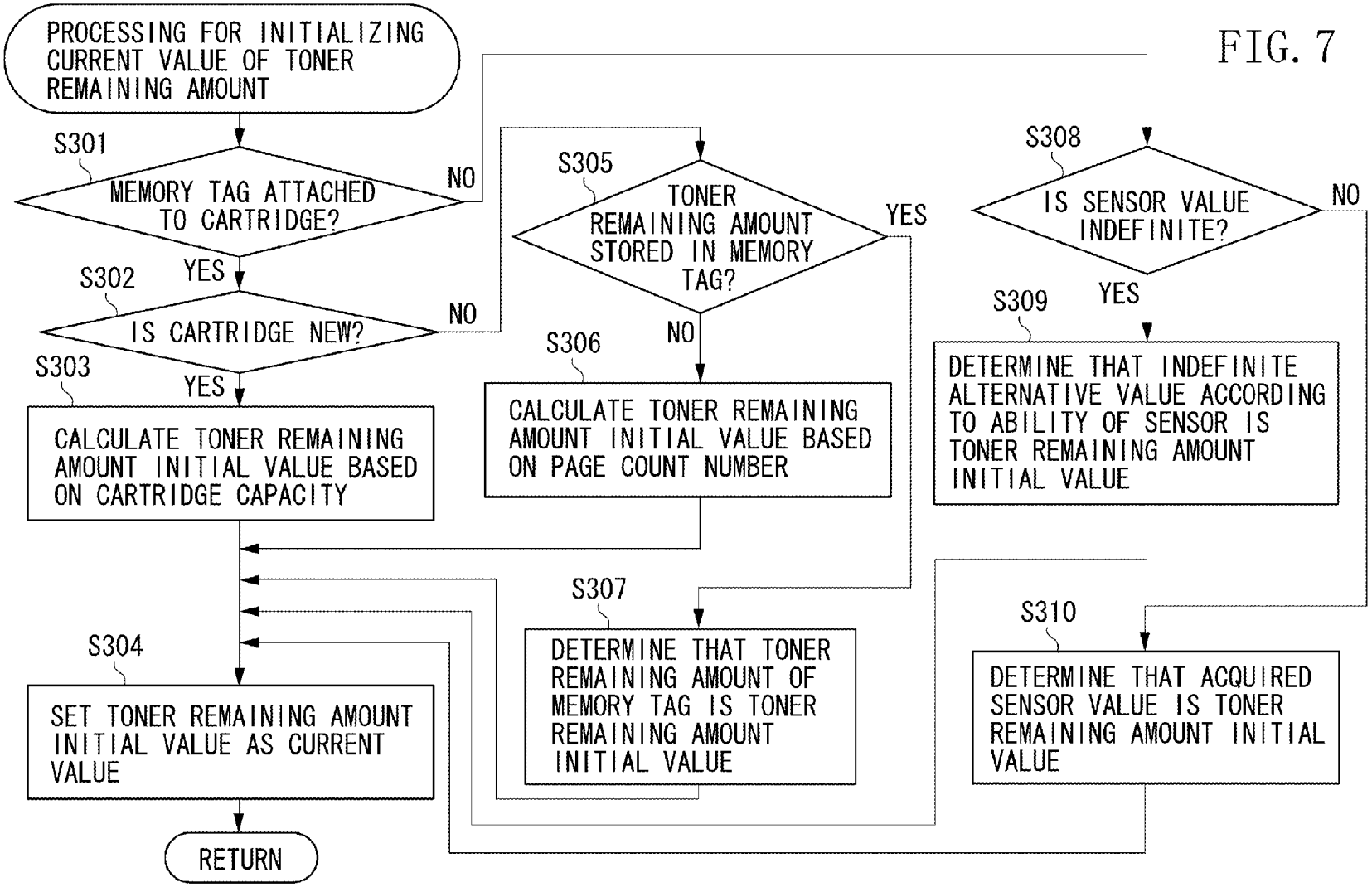
FIG. 7 is a flowchart illustrating details of processing for initializing a current value of the toner remaining amount.

FIG. 7 is a flowchart illustrating details of processing for initializing the current value of the toner remaining amount.

When the processing illustrated in FIG. 7 is executed, various types of information (those described above with reference to FIG. 6) of the memory tag included in the cartridge information received in step S103 are used.

First, in step S301, the CPU 401 determines whether the memory tag is attached to the cartridge 509, based on the cartridge information received in step S103. Specifically, when the various types of information described above with reference to FIG. 6 are included in the cartridge information received in step S103, the CPU 401 determines that the memory tag is attached to the cartridge 509. Otherwise the CPU 401 determines that the memory tag is not attached to the cartridge 509. When the CPU 401 determines that the memory tag is attached to the cartridge 509 (YES in step S301), the CPU 401 proceeds to step S302. When the CPU 401 determines that the memory tag is not attached to the cartridge 509 (NO in step S301), the CPU 401 proceeds to step S308.

Next, in step S302, the CPU 401 determines whether the cartridge 509 is new based on the new flag 613. Specifically, when the new flag 613 included in the cartridge information is ON, the CPU 401 determines that the cartridge 509 is new. On the other hand, when the new flag 613 is OFF, the CPU 401 determines that the cartridge 509 is not new. When the CPU 401 determines that the cartridge 509 is new (YES in step S302), the CPU 401 proceeds to step S303. When the CPU 401 determines that the cartridge 509 is not new (NO in step S302), the CPU 401 proceeds to step S305.

Then, in step S303, the CPU 401 calculates a toner remaining amount initial value based on the capacity 611. Specifically, the CPU 401 calculates the toner remaining amount initial value by using the following expression:

$$A_i = C_t \times P_i,$$

where $A_i$ denotes the toner remaining amount initial value [μg], $C_t$ denotes the toner consumption amount per page of specific data [μg/sheet] (a predetermined value), and $P_i$ denotes the number of printable pages using the specific data [sheets] (the capacity 611). A sign "×" refers to multiplication. $P_i$ and $C_t$ are values that are predetermined assuming a case of printing the specific data (standard data such as ISO data). The toner consumption amount $C_t$ may be defined in a module of a program held in the ROM 402, or may be held by the memory tag of the cartridge 509 as the cartridge information. The above expression "$C_t \times P_i$" is not limited to this example of calculation. For example, a predetermined value according to the type of the cartridge 509 may be directly defined in a module of a program held in the ROM 402, or may be directly held by the memory tag of the cartridge 509 as the cartridge information.

Next, in step S304, the CPU 401 sets the calculated toner remaining amount initial value as an initial value of the current value of the toner remaining amount. Specifically, the CPU 401 divides the toner remaining amount initial value calculated in each of steps S303, S306, S307, S309, and S310, by "$C_t \times P_i$" that is the capacity when the cartridge 509 is new. As a result, the value of the toner remaining amount is obtained in "%". The CPU 401 then sets the obtained value as the initial value of the current value of the toner remaining amount.

On the other hand, when the CPU 401 determines that the cartridge 509 is not new (NO in step S302), in step S305, the CPU 401 determines whether the toner remaining amount value 621 is stored in the memory tag. Specifically, when the toner remaining amount value 621 is included in the cartridge information received in step S103, the CPU 401 determines that the toner remaining amount value 621 is stored in the memory tag. Otherwise the CPU 401 determines that the toner remaining amount value 621 is not stored in the memory tag. When the CPU 401 determines that the toner remaining amount value 621 is stored in the memory tag (YES in step S305), the CPU 401 proceeds to step S307. When the CPU 401 determines that the toner remaining amount value 621 is not stored in the memory tag (NO in step S305), the CPU 401 proceeds to step S306.

Next, in step S306, the CPU 401 calculates a toner remaining amount initial value based on the page count 614. Specifically, the CPU 401 calculates the toner remaining amount initial value by using the following expression:

$$A_i = C_t \times P_i - C_t \times P_n,$$

where $A_i$ denotes the toner remaining amount initial value [μg], $C_t$ denotes the toner consumption amount per page of the specific data [μg/sheet] (a predetermined value), $P_i$ denotes the number of printable pages using the specific data [sheets] (the capacity 611), and $P_n$ denotes the number of print pages [sheets] (the page count 614). A sign "−" refers to subtraction. The expression used in step S306 may be used in step S303. This is because, when the cartridge 509 is new, "$P_n$" is 0 and therefore "$C_t \times P_n$" is also 0, so that the expression in step S306 is equivalent to the expression in step S303. In the flowchart, this case is equivalent to a case in which steps S302 and S303 are removed and the CPU 401 directly proceeds to step S305 when the CPU 401 determines that the memory tag is attached to the cartridge 509 (YES in step S301).

On the other hand, when the CPU 401 determines that the toner remaining amount value 621 is stored in the memory tag (YES in step S305), in step S307, the CPU 401 determines that the toner remaining amount value 621 is the toner remaining amount initial value.

When the CPU 401 determines that the memory tag is not attached to the cartridge 509 (NO in step S301), in step S308, the CPU 401 acquires the sensor value of the toner remaining amount, and determines whether the acquired sensor value is an indefinite value. Specifically, at first, the CPU 401 acquires the sensor value of the toner remaining amount by executing processing similar to the processing in steps S112 and S113 in FIG. 5B. When the acquired sensor value falls outside a range of 0% to 100% or acquisition of the sensor value has failed, the CPU 401 determines that the sensor value is an indefinite value. Otherwise the CPU 401 determines that the sensor value is not an indefinite value. When the CPU 401 determines that the sensor value is an indefinite value (YES in step S308), the CPU 401 proceeds to step S309. When the CPU 401 determines that the sensor value is not an indefinite value (NO in step S308), the CPU 401 proceeds to step S310.

Then, in step S309, the CPU 401 determines that a predetermined alternative value according to the ability of the toner remaining amount sensor 504 is the toner remaining amount initial value. A value expressed by "(an upper limit allowing remaining amount measurement by 1%)+1" (%) is used as the predetermined alternative value. Alternatively, when the Low level (e.g., 20%) indicating that a toner remaining amount is small is provided, and the remaining mount measurement by 1% cannot be performed for a value greater than a Low notification value, a value expressed by "(the Low notification value)+1" (%) may be used as the predetermined alternative value.

On the other hand, when the CPU 401 determines that the sensor value is not an indefinite value (NO in step S308), in step S310, the CPU 401 determines that the sensor value acquired in step S308 is the toner remaining amount initial value.

According to the present exemplary embodiment, the toner remaining amount can be appropriately set even if the toner remaining amount value is not stored in the memory tag of the cartridge when the cartridge is newly mounted.

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-179997 filed Aug. 30, 2013, which is hereby incorporated by reference herein in its entirety.

What is claimed is:

1. An image forming apparatus performing printing on a sheet using a recording material, the image forming apparatus comprising:

a processor;

a memory device;

a determining unit configured to determine, in a case where a containing unit storing the recording material is mounted on the image forming apparatus, whether remaining amount information indicating a remaining amount of the recording material is stored in a memory of the containing unit;

a calculating unit configured to calculate, in a case where the determining unit has determined that the remaining amount information is not stored in the memory, a remaining amount of the recording material based on a number of printed pages stored in the memory; and a notifying unit configured to notify a user of a remaining amount indicated by the remaining amount information as the remaining amount of the recording material in a case where the determining unit has determined that the remaining amount information is stored in the memory, and to notify a user of a remaining amount calculated by the calculating unit as the remaining amount of the recording material in a case where the determining unit has determined that the remaining amount information is not stored in the memory, wherein the determining unit, the calculating unit and the notifying unit are implemented at least in part by the processor executing at least one program recorded on the memory device.

2. The image forming apparatus according to claim 1, wherein the calculating unit calculates the remaining amount of the recording material by subtracting a consumed amount of the recording material calculated based on the number of printed pages from a greatest amount of the recording material that can be stored in the containing unit.

3. The image forming apparatus according to claim 2, wherein the calculating unit calculates the consumed amount of the recording material by multiplying a consumed amount of the recording material per page by the number of printed pages.

4. The image forming apparatus according to claim 2, wherein the calculating unit calculates the greatest amount of the recording material by multiplying the consumed amount of the recording material per page by a number of printable pages stored in the memory.

5. The image forming apparatus according to claim 1, wherein the notifying unit displays the remaining amount of the recording material on a user interface.

6. The image forming apparatus according to claim 1, wherein the recording material is a toner and the containing unit is a cartridge.

7. An image forming apparatus performing printing on a sheet using a recording material, the image forming apparatus comprising:

a processor;

a memory device;

a first determining unit configured to determine, in a case where a containing unit storing the recording material is mounted on the image forming apparatus, whether the containing unit is new;

a second determining unit configured to determine, in a case where the first determining unit has determined that the containing unit is not new, whether remaining amount information indicating a remaining amount of the recording material is stored in a memory of the containing unit;

a calculating unit configured to calculate, in a case where the second determining unit has determined that the remaining amount information is not stored in the memory, a remaining amount of the recording material based on a number of printed pages stored in the memory;

a notifying unit configured to notify a user of a greatest amount of the recording material that can be stored in the containing unit as the remaining amount of the recording material in a case where the first determining unit has determined that the containing unit is new, to notify a user of the remaining amount of the recording material indicated by the remaining amount information as the remaining amount of the recording material in a case where the second determining unit has determined that the remaining amount information is stored in the memory, and to notify a user of the remaining amount of the recording material calculated by the calculating unit in a case where the second determining unit has determined that the remaining amount information is not stored in the memory, wherein the first determining unit, the second determining unit, the calculating unit and the notifying unit are implemented at least in part by the processor executing at least one program recorded on the memory device.

8. The image forming apparatus according to claim 7, wherein the first determining unit determines whether the containing unit is new based on a new flag stored in the memory.

9. The image forming apparatus according to claim 7, wherein the greatest amount of the recording material is calculated by multiplying a consumed amount of the recording material per page by a number of printable pages stored in the memory.

10. The image forming apparatus according to claim 7, wherein the calculating unit calculates the remaining amount of the recording material by subtracting a consumed amount of the recording material calculated based on the number of printed pages from the greatest amount of the recording material.

11. The image forming apparatus according to claim 10, wherein the calculating unit calculates the consumed amount of the recording material by multiplying a consumed amount of the recording material per page by the number of printed pages stored in the memory.

12. The image forming apparatus according to claim 10, wherein the calculating unit calculates the greatest amount of the recording material by multiplying a consumed amount of the recording material per page by the number of printable pages stored in the memory.

13. The image forming apparatus according to claim 7, wherein the notifying unit displays the remaining amount of the recording material on a user interface.

14. The image forming apparatus according to claim 7, wherein the recording material is a toner and the containing unit is a cartridge.

15. A method of controlling an image forming apparatus that performs printing on a sheet using a recording material, the method comprising:

determining, in a case where a containing unit storing the recording material is mounted on the image forming apparatus, whether remaining amount information indicating a remaining amount of the recording material is stored in a memory of the containing unit;

calculating, in a case where the determining unit has determined that the remaining amount information is not stored in the memory, a remaining amount of the recording material based on a number of printed pages stored in the memory; and notifying a user of a remaining amount indicated by the remaining amount information as the remaining amount of the recording material in a case where a determination has been made that the remaining amount information is stored in the memory, and notifying a user of a calculated remaining amount as the remaining amount of the recording material in a case where a determination has been made that the remaining amount information is not stored in the memory.

16. A method of controlling an image forming apparatus that performs printing on a sheet using a recording material, the method comprising:

determining, in a case where a containing unit storing the recording material is mounted on the image forming apparatus, whether the containing unit is new;

determining, in a case where the it has been determined that the containing unit is not new, whether remaining amount information indicating a remaining amount of the recording material is stored in a memory of the containing unit;

calculating, in a case where it has been determined that the remaining amount information is not stored in the memory, a remaining amount of the recording material based on a number of printed pages stored in the memory;

notifying a user of a greatest amount of the recording material that can be stored in the containing unit as the remaining amount of the recording material in a case where a determination has been made that the containing unit is new;

notifying a user of the remaining amount of the recording material indicated by the remaining amount information as the remaining amount of the recording material in a case where a determination has been made that the remaining amount information is stored in the memory; and notifying a user of the calculated remaining amount of the recording material in a case where a determination has been made that the remaining amount information is not stored in the memory.

17. A non-transitory computer readable storage medium storing instructions that, when executed by a processor, execute a method of controlling an image forming apparatus that performs printing on a sheet using a recording material, the method comprising:

determining, in a case where a containing unit storing the recording material is mounted on the image forming apparatus, whether remaining amount information indicating a remaining amount of the recording material is stored in a memory of the containing unit;

calculating, in a case where the determining unit has determined that the remaining amount information is not stored in the memory, a remaining amount of the recording material based on a number of printed pages stored in the memory; and notifying a user of a remaining amount indicated by the remaining amount information as the remaining amount of the recording material in a case where a determination has been made that the remaining amount information is stored in the memory, and notifying a user of a calculated remaining amount as the remaining amount of the recording material in a case where a determination has been made that the remaining amount information is not stored in the memory.

18. A non-transitory computer readable storage medium storing instructions that, when executed by a processor, execute a method of controlling an image forming apparatus that performs printing on a sheet using a recording material, the method comprising:

determining, in a case where a containing unit storing the recording material is mounted on the image forming apparatus, whether the containing unit is new;

determining, in a case where the it has been determined that the containing unit is not new, whether remaining amount information indicating a remaining amount of the recording material is stored in a memory of the containing unit;

calculating, in a case where it has been determined that the remaining amount information is not stored in the memory, a remaining amount of the recording material based on a number of printed pages stored in the memory;

notifying a user of a greatest amount of the recording material that can be stored in the containing unit as the remaining amount of the recording material in a case where a determination has been made that the containing unit is new;

notifying a user of the remaining amount of the recording material indicated by the remaining amount information as the remaining amount of the recording material in a case where a determination has been made that the remaining amount information is stored in the memory; and notifying a user of the calculated remaining amount of the recording material in a case where a determination has been made that the remaining amount information is not stored in the memory.

* * * * *